United States Patent [19]

Ribka et al.

[11] 4,265,629

[45] May 5, 1981

[54] PROCESS FOR THE PRODUCTION OF RESIST EFFECTS ON POLYESTER/CELLULOSE MIXED FIBRE TEXTILES

[75] Inventors: Joachim Ribka, Offenbach am Main; Horst Tappe, Dietzenbach; Kurt Roth, Hofheim; Hans-Jürgen Weyer, Frankfurt am Main, all of Fed. Rep. of Germany

[73] Assignee: Cassella Aktiengesellschaft, Frankfurt, Fed. Rep. of Germany

[21] Appl. No.: 105,204

[22] Filed: Dec. 19, 1979

[30] Foreign Application Priority Data

Dec. 27, 1978 [DE] Fed. Rep. of Germany ..... 2856283

[51] Int. Cl.[3] ..... D06P 5/12

[52] U.S. Cl. ..... 8/449; 8/451; 8/456; 8/464; 8/532

[58] Field of Search ..... 8/21 C, 26, 41 C, 163, 8/68, 69, 449, 451, 456, 532, 464

[56] References Cited

U.S. PATENT DOCUMENTS

| | | | |
|---|---|---|---|
| 2,659,719 | 11/1953 | Dickey et al. | 548/191 |
| 3,972,677 | 8/1976 | Feess et al. | 8/464 |
| 4,023,925 | 5/1977 | Fadler et al. | 8/532 |
| 4,134,723 | 1/1979 | Boyd et al. | 8/41 C |

FOREIGN PATENT DOCUMENTS

| | | |
|---|---|---|
| 2326522 | 12/1974 | Fed. Rep. of Germany . |
| 2846247 | 4/1979 | Fed. Rep. of Germany . |
| 1281080 | 7/1972 | United Kingdom . |
| 1512321 | 6/1978 | United Kingdom . |
| 1543724 | 4/1979 | United Kingdom . |

*Primary Examiner*—A. Lionel Clingman
*Attorney, Agent, or Firm*—Connolly & Hutz

[57] ABSTRACT

In the process for production of resist effects on textile materials of mixed fibers of polyester and cellulose comprising impregnating the materials with a dye liquor containing disperse dyestuffs and reactive dyestuffs which react with the resisting agents, drying or partially drying the padded materials and subsequently printing a resist paste on the material, and heat-treating the materials the improvement comprises the dischargeable disperse dyestuffs being of a class of dyestuffs of which an exemplary species is

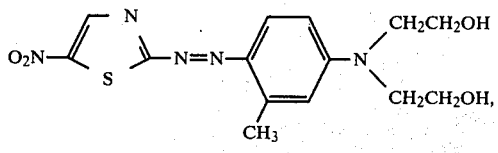

one of the tautomeric forms of a class of dyestuffs of which an exemplary species is

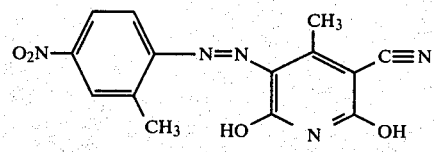

or disperse dyestuffs which are free from groups conferring solubility in water and which contain at least two carboxylic acid ester moieties.

6 Claims, No Drawings

PROCESS FOR THE PRODUCTION OF RESIST EFFECTS ON POLYESTER/CELLULOSE MIXED FIBRE TEXTILES

The present invention relates to a process for the production of resist effects on textile materials based on mixed fibres of polyester and cellulose, in particular polyester/cotton fibres, by impregnating the materials with dye liquors which contain, in addition to the customary dyeing and padding auxiliaries, disperse dyestuffs and reactive dyestuffs which react with the resisting agents, and which optionally contain other disperse dyestuffs and reactive dyestuffs which are stable towards the resisting agents, drying or partially drying the padded materials and then printing a resist paste on which, if desired, in addition to the resisting agent, contains disperse dyestuffs and reactive dyestuffs which are stable towards the resisting agent, heat-treating the materials at temperatures from 100° to 190° C. and subsequently fixing the reactive dyestuff under alkaline conditions in a manner which is in itself known, characterised in that the dischargeable disperse dyestuffs employed are those of the formula I

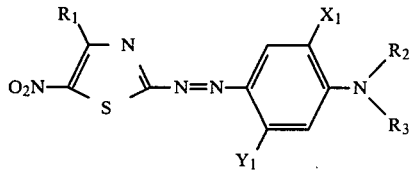

(I)

wherein $R_1$ denotes hydrogen, cyano or optionally substituted alkyl or phenyl; $X_1$ denotes hydrogen, halogen or optionally substituted alkyl or alkoxy; $Y_1$ denotes hydrogen, halogen, optionally substituted alkyl or alkoxy, —NH—CO—$Y_2$ or —NH—$SO_2$—$Y_2$, wherein $Y_2$ represents alkyl, phenyl or amino; $R_2$ denotes hydrogen, optionally substituted alkyl or alkenyl; and $R_3$ denotes optionally substituted alkyl, or alkenyl or phenyl, or those of the formula II

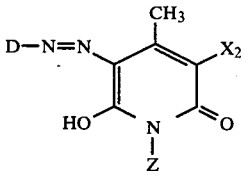

(II)

wherein D represents phenyl, which optionally contains at least one substituent; $X_2$ represents hydrogen, lower alkyl, carbamoyl, cyano, chlorine, bromine, nitroso, nitro, lower alkylcarbonyl, sulphamoyl, lower alkylsulphonyl, lower alkylcarbonylamino or lower alkoxycarbonyl; and Z represents hydrogen or lower alkyl; or disperse dyestuffs which are free from groups conferring solubility in water and which contain at least two carboxylic acid ester groups, the dischargeable reactive dyestuffs employed are those which contain reactive radicals of the formulae III to VI $$-SO_2-CH_2-CH_2-hal \quad (III)$$

$$-SO_2-CH_2-CH_2-O-SO_3M \quad (IV)$$

$$-NH-SO_2-CH_2-CH_2-O-SO_3M \quad (V)$$

$$-SO_2-CH=CH_2 \quad (VI)$$

wherein M denotes hydrogen or a metal cation and hal denotes halogen, and a resist paste which contains, as the resisting agent, (a) an alkali metal sulphite or an alkali metal bisulphite in combination with an alkali metal carbonate or alkali metal bicarbonate, and, if appropriate, an aldehyde, and (b) if appropriate, a non-ionic detergent, is employed.

In the field of textile printing it has always been a problem to produce white or coloured sharply outlined patterns on a deep-coloured background. Direct printing of the textile material fails completely, especially when the production of filagree-like patterns on a dark background is desired. In order to produce such designs, it has been known for a long time to print a discharge paste, in the desired pattern, onto a deep background dyeing produced with a dyestuff which is dischargeable to white and then to destroy the dyestuff at the points printed with the discharge paste, by dry or wet heat treatment. After washing out the prints thus obtained, the desired pattern is obtained in white on the dark background. It is also already known to add to the discharge printing pastes dyestuffs which are resistant towards the discharge agent. In this case, at the same time as the background dyeing is destroyed, the textile material is dyed at the printed points by the indestructible dyestuff. Coloured prints on a dark background are obtained in this case. Coloured prints on a dark background can also be obtained if the dark background is produced with a mixture of a dischargeable dyestuff and a non-dischargeable dyestuff of a different colour by incorporating both types of dyestuff into the padding liquor.

A process for the production of resist effects with reactive dyestuffs on natural or regenerated cellulose fibre materials is described in German Auslegeschrift No. 2,326,522 (*) In this process, sulphites, thiosulphites or thioureas, as resisting agents, alkalis, as fixing agents, and reactive dyestuffs which (a) react with the resisting agent and possess, as the reactive group, the β-sulphatoethylsulphonyl or β-sulphatoethylsulphonamide group and which (b) on fixing do not react with the resisting agents and possess, as the reactive group, the chloroaminotriazine, dichloropyrimidine, trichloropyrimidine, dichlorotriazine, monochlorotriazine, quaternised chlorotriazine or dichloropyridazine group, are printed onto the textile material in a pre-printing or cover-printing process, the material is dried and the dyestuffs are then fixed by steaming or by a hot air treatment.

(*)examined document laid open to public inspection

It is also already known to dye mixtures of aromatic polyester fibres and cellulose fibres with mixtures of disperse dyestuffs and reactive dyestuffs. In this known process, the cellulose fibres are also stained somewhat by the disperse dyestuffs. It is exceptionally difficult to remove the disperse dyestuff from the cellulose fibres by reduction without simultaneously destroying the reaction dyestuff.

When the known discharge resist printing process is used on textile materials which consist of mixtures of aromatic polyester fibres and cellulose fibres, there is a problem inasmuch as the discharge of, for example, polyester fibres stained with disperse dyestuffs is very difficult. Disperse dyestuffs once fixed in the polyester fibres, that is to say dissolved, are largely removed from attack by aqueous agents and thus also from attack by aqueous discharge pastes. For producing discharge prints on textile materials containing hydrophobic fibres or consisting of hydrophobic fibres, the known discharge printing process is thus modified such that the textile material is first padded with a dye liquor containing the disperse dyestuff and reactive dyestuff and is dried or partially dried, during which, however, no fixing of the dyestuff, that is to say solution of the disperse dyestuff in the hydrophobic fibre, should take place. The desired pattern is then printed onto the dried or partially dried padded fabric with the discharge printing paste and the padded and printed fabric is then subjected to a heat treatment, at the same time of which the background dyestuff migrates into the polyester at the non-printed points, the reactive dyestuff is fixed on the cellulose and the dyestuff at the printed points is destroyed, that is to say no dyeing takes place. In view of this mechanism, this process is also called discharge resist printing.

The process of discharge resist printing, which is in itself simple, comprises a number of industrial difficulties which frequently impede its use. Thus, as a rule, it is not simple to destroy the background dyestuff without trace by the discharge agent. If this does not occur, a coloured residue remains at the discharged points, the shade of which can vary between yellow-brown and dull violet or reddish-tinged grey hues and which stains the white background at the discharged points. This leads to a white discharge which appears dirty or, in the case where a coloured discharge is to be produced, to a falsification of the shade of the dyestuff which is resistant to the discharge agent. In order to overcome this difficulty, discharge pastes which contain relatively powerful reducing agents or oxidising agents, such as, for example, sodium dithionite in association with an alkali, alkali metal formaldehydesulphoxylates or even heavy metal salts, such as, for example, tin-II chloride, are used. Using such powerful discharge agents it is indeed as a rule possible to produce a perfect white discharge print, but the fibre material is frequently damaged, especially if the polyester fibre also contains accompanying fibres, such as, for example, cellulose fibres. Furthermore, these discharge agents are as a rule not cheap and, in the case of the heavy metal discharge agents, they represent an additional ecological problem or cause additional expenditure in purification of the effluents. Moreover, there are only relatively few types of disperse dyestuffs and reactive dyestuffs which are resistant to such discharge agents, and thus the choice of dyestuffs which are resistant to discharge agents and can be used for the production of coloured discharges is relatively small.

It is also already known to produce resist effects on hydrophobic fibres by padding the fibre materials with dye liquors which contain disperse dyestuffs containing carboxylic acid ester groups. After drying the padded fabric, discharge printing pastes which contain, as the discharge agent, an alkali in combination with polyhydric aliphatic alcohols, such as glycol, glycerol or a polyglycol, are printed on. However, such discharge agent combinations have an adverse effect on the fixing properties of the dyestuffs, that is to say in the case of the production of coloured resists, the colour yields of the dyestuffs which are resistant to discharge agents are reduced.

The abovementioned disadvantages of the known processes for the production of resist effects on textile materials based on mixed fibres of polyester and cellulose, in particular polyester/cotton fibres, by impregnating the materials with dye liquors which contain, in addition to the customary dyeing and padding auxiliaries, disperse dyestuffs and reactive dyestuffs which react with the resisting agents, and which optionally contain other disperse dyestuffs and reactive dyestuffs which are stable towards the resisting agents, and, if appropriate, an alkali metal formate, drying or partially drying the padded materials and subsequently printing a resist paste on which contains, if desired, in addition to the resisting agent, disperse dyestuffs and reactive dyestuffs which are stable towards the resisting agent, heat-treating the materials at temperatures of 100° to 190° C. and, if appropriate, subsequently fixing the reactive dyestuff under alkaline conditions in a manner which is in itself known can be overcome, surprisingly, by a process in which 1. the dischargeable disperse dyestuffs employed are those of the formula I

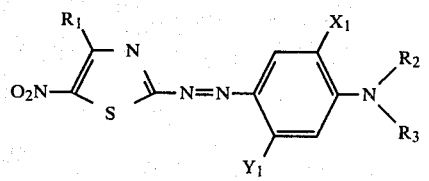

I wherein $R_1$ denotes hydrogen, alkyl with 1 to 6 C atoms, cyano, trifluoromethyl or a phenyl radical which can be substituted by one substituent from the group comprising chlorine, bromine, nitro and alkyl with 1 to 4 C atoms; $X_1$ denotes hydrogen, chlorine, bromine, alkyl with 1–4 C atoms which is optionally substituted by a substituent from the group comprising chlorine, bromine, cyano and hydroxyl, alkoxy with 1 to 4 C atoms, hydroxyalkoxy with 2 to 4 C atoms or alkoxyalkoxy with a total of 3 to 6 C atoms; $Y_1$ denotes hydrogen, chlorine, bromine, alkyl with 1 to 4 C atoms which is optionally substituted by a substituent from the group comprising chlorine, bromine, cyano and hydroxyl, alkoxy with 1 to 4 C atoms, hydroxyalkoxy with 2 to 4 C atoms, alkoxyalkoxy with a total of 3 to 6 C atoms, —NH—CO—$Y_2$ or —NH—$SO_2Y_2$ wherein $Y_2$ represents phenyl, amino or N-alkylamino with 1 to 4 C atoms, or alkyl with 1 to 4 C atoms, it being possible for the alkyl radical to be optionally substituted with a substituent from the group comprising phenyl, chlorine, bromine, cyano, hydroxyl, alkoxy with 1 to 2 C atoms and phenoxy; $R_2$ denotes hydrogen, alkyl with 1–6 C atoms which is optionally substituted by chlorine, bromine, cyano, hydroxyl, alkoxy or hydroxyalkoxy with 1 to 4 C atoms, phenyl, alkanoyloxy with 2–4 C atoms, alkoxycarbonyl with 1 to 4 C atoms, hydroxycarbonyl with 2–4 C atoms, alkylaminocarbonyloxy with 2–4 C atoms or phenylaminocarbonyloxy, hydroxyalkyl with 2–4 C atoms or alkenyl with 3–6 C atoms; $R_3$ denotes alkyl with 1 to 6 C atoms which is optionally substituted by chlorine, bromine, cyano, hydroxyl, alkoxy or hydroxyalkoxy with 1–4 C atoms, phenyl, alkanoyloxy with 2–4 C atoms, alkoxycarbonyl with 1 to 4 C atoms, hydroxycarbonyl with 2–4 C atoms or alkylaminocarbonyloxy with 2 to 4 C atoms, hydroxyalkyl with 2 to 4 C atoms, alkenyl with 3 to 6 C atoms or phenyl and, if $R_2$ is hydrogen, also the group —$C(CH_3)_2$—$COOR_4$, wherein $R_4$ is alkyl with 4 to 8 C atoms or methoxy-, ethoxy- or propoxy-alkyl with a total of 4 to 8 C atoms, or those which, in one of the possible tautomeric forms, correspond to the formula II

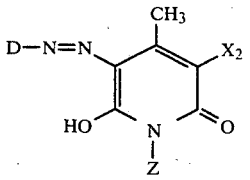

(II)

wherein D represents phenyl which optionally contains at least one substituent chosen from the group comprising chlorine, bromine, nitro, cyano, trifluoromethyl, thiocyano, lower alkyl, lower alkoxy, lower alkylcarbonyl, lower alkylsulphonyl, lower alkylcarbonylamino, carbamoyl and N-lower alkyl and N,N-di-lower alkyl derivatives thereof, sulphamoyl and N-lower alkyl and N,N-di-lower alkyl derivatives thereof, sulphamato and N-lower alkyl and N,N-di-lower alkyl derivatives thereof, lower alkoxycarbonyl, lower alkoxy-lower alkoxycarbonyl, lower alkoxy-lower alkoxy-lower alkoxycarbonyl, hydroxy-lower alkoxycarbonyl, hydroxy-lower alkoxy-lower alkoxycarbonyl and lower alkoxycarbonyl-lower alkyl; $X_2$ represents hydrogen, lower alkyl, carbamoyl, cyano, chlorine, bromine, nitroso, nitro, lower alkylcarbonyl, sulphamcyl, lower alkylsulphonyl, lower alkylcarbonylamino or lower alkoxycarbonyl; and Z represents hydrogen or lower alkyl; or disperse dyestuffs which are free from groups conferring solubility in water and which contain at least two carboxylic acid ester groups and are from the nitro series, methine series, axomethine series, anthraquinone series or, above all, the azo series or, very particularly, the monoazo series, the carboxylic acid ester groups preferably having the formula —$COOR_5$ wherein $R_5$ represents an optionally substituted hydrocarbon or heterocyclic radical, 2. the dischargeable reactive dyestuffs employed are those which contain reactive radicals of the formulae III to VI $$-SO_2-CH_2-CH_2-hal \quad (III)$$

$$-SO_2-CH_2-CH_2-O-SO_3M \quad (IV)$$

$$-NH-SO_2-CH_2-CH_2-O-SO_3M \quad (V)$$

$$-SO_2-CH=CH_2 \quad (VI)$$

wherein M denotes hydrogen or a metal cation and hal denotes halogen, and a resist paste which contains, as the resisting agent, (a) an alkali metal sulphite or an alkali metal bisulphite in combination with an alkali metal carbonate or alkali metal bicarbonate, and, if appropriate, an aldehyde, and (b) if appropriate, a non-ionic detergent, is employed.

The following paragraphs serve to describe in detail the disperse dyestuffs of the formula I which are particularly advantageously to be employed according to the invention.

Examples of alkyl radicals with 1–6 C atoms which $R_1$ in formula I can represent are methyl; ethyl; propyl; isopropyl; butyl; 1- and 2-isobutyl; pent-1-yl, -2-yl and -3-yl; 2- or 3-methylbut-1-yl or -2-yl; hex-1-yl, -2-yl or -3-yl; 1-, 2-or 3-ethylbut-1-yl or -2-yl; and 2-, 3- or 4-methylpent-1-yl.

Examples of substituents which $X_1$ in the formula I can represent are: chlorine; bromine; ethyl; methyl; propyl; isopropyl; but-1-yl or -2-yl; isobutyl; β-chloro-, -bromo-, -cyano- or -hydroxy-ethyl; β-chloro-, -bromo-, -cyano- or -hydroxy-propyl; γ-chloro-, -bromo-, -cyano- or -hydroxy-propyl; β- or γ-chloro-, -bromo-, -cyano- or -hydroxy-but-1-yl; 3-chloro-, -bromo-, -cyano- or -hydroxy-but-2-yl; methoxy, ethoxy, propoxy or isopropoxy; but-1- or -2-oxy; isobutoxy; β-hydroxyethoxy; β- or γ-hydroxypropoxy; hydroxyisopropoxy; β-, γ- or δ-hydroxybutoxy; hydroxyisobutoxy; β-methoxyethoxy; β-ethoxyethoxy; β-propoxyethoxy; β-butoxyethoxy; β- or γ-propoxypropoxy; and β-, γ- or δ-methoxy- or -ethoxy-butoxy.

Examples of substituents which $Y_1$ can represent are: methyl; ethyl; prop-1-yl or -2-yl; n-but-1-yl or -2-yl; isobut-1-yl, -2-yl or -3-yl; 2-chloroethyl; 2-chloropropyl; 3-chloropropyl; 2-bromoethyl; 2-cyanoethyl; 2-cyanopropyl; 3cyanopropyl; 1- or 2-hydroxyethyl; 2- or 3-hydroxyprop-1-yl; methoxy; ethoxy; propoxy; isopropoxy; butoxy; isobutoxy; β-hydroxyethoxy; 2- or 3-hydroxypropoxy; 2- or 4-hydroxy-but-2-oxy; methoxyethoxy; ethoxymethoxy; 2- or 3-methoxyprop-1-oxy; 2- or 3-ethoxyprop-1-oxy; 2- or 4-methoxybut-1-oxy; 2-or 4-ethoxybut-1-oxy; 4-methoxy- or -ethoxy-but-2-oxy; 1- or 2-methoxy- or -ethoxy-but-2-oxy; acetylamino; propionylamino; butyrylamino; phenacetylamino; chloro-, bromo-, cyano- or hydroxyacetylamino; 2- or 3-chloro- or bromo-propionylamino; 2- or 3-hydroxypropionylamino; 2- or 3-cyanopropionylamino; 2-, 3- or 4-chloro- or -bromobutyrylamino; 2-, 3- or 4-cyanobutyrylamino; 2-, 3- or 4-hydroxybutyrylamino; methoxyacetylamino; 2- or 3-methoxy- or -ethoxy-propionylamino; 2-, 3- or 4-methoxybutyrylamino; phenoxyacetylamino; benzoylamino; aminocarbonylamino; methyl-, ethyl-, propyl- or butyl-aminocarbonylamino; isopropylaminocarbonylamino; and iso- or sec.-butylaminocarbonylamino.

Examples of optionally substituted lower alkyl groups with 1–6 C atoms which $R_2$ or $R_3$ represent are: methyl, ethyl, propyl, isopropyl, butyl, isobutyl, sec.-butyl, pent-1-yl, -2-yl or -3-yl, hex-1-yl, -2-yl or -3-yl, 2-chloro-, -bromo- or -cyano-ethyl, 2- or 3-chloro-, -bromo- or -cyano-prop-1-yl; 2-, 3- or 4-chloro-, -bromo- or -cyano-but-1-yl; 1-, 3- or 4-chloro-, -bromo- or -cyano-but-2-yl; methoxy-, ethoxy-, propoxy-, isopropoxy- or butoxy-ethyl; β-(β-hydroxyethoxy)-ethyl; 2- or 3-methoxy- or -ethoxy-prop-1-yl; benzyl; phenethyl; phenylpropyl; acetoxy-, propionyloxy- or butyryloxy-ethyl; 2- or 3-acetoxy-, -propionyloxy- or -butyryloxy-prop-1-yl; 2-, 3- or 4-acetoxybut-1-yl; phenoxyacetoxy-ethyl, -propyl or -butyl; methyl-, ethyl-, propyl-, butyl- or phenyl-aminocarbonyloxyeth-2-yl or -3-yl; methyl-, ethyl-, propyl- or butyl-aminocarbonyloxy-prop-1-yl or -but-1-yl; 2-hydroxyethyl; 2- or 3-hydroxyprop-1-yl; 3-hydroxyprop-2-yl; 2-, 3- or 4-hydroxybut-1-yl; 1-, 3- or 4-hydroxybut-2-yl; methoxy-, ethoxy-, propoxy-, isopropoxy-, but-1-oxy-, but-2-oxy- or isobutoxy-carbonyl; and β-hydroxyethoxy-, -hydroxypropoxy- or -hydroxybutoxy-carbonyl.

Examples of alkenyl groups which $R_2$ or $R_3$ represent are: allyl; methallyl; crotyl; but-3-en-1-yl; but-3-en-2-yl; pent-2-, -3- or -4-en-1-yl; pent-3- or -4-en-2-yl; and hex-2-, -3-, -4- or -5-en-1-yl.

Examples of alkyl and alkoxyalkyl groups which $R_4$ can represent are: methyl; ethyl; isopropyl; propyl; n-butyl; sec.-butyl; isobutyl; pentyl; hexyl; 2-ethylhex-1-yl; methoxy-, ethoxy- or propoxy-ethyl; 2- or 3-methoxy-, -ethoxy- or -propoxy-prop-1-yl; 2-, 3- or 4-methoxy-, -ethoxy- or -propoxy-but-1-yl; 1-, 3- or 4-methoxy-, -ethoxy- or -propoxy-but-2-yl; and methoxy-, -ethoxy- or -propoxy-pentyl and ethoxyhexyl.

Dyestuffs which are particularly preferably used in the process according to the invention are those of the formula I in which $R_1$ denotes hydrogen and $R_2$ is free from alkoxycarbonyl and hydroxyalkoxycarbonyl groups. Another preferred group of dyestuffs of the formula I comprises those dyestuffs which contain hydroxy groups in the radicals $R_2$ and/or $R_3$, especially those in which $R_2$ is ethyl or β-hydroxyethyl and $R_3$ is β-hydroxyethyl or those in which $R_2$ is hydrogen and $R_3$ is an alkoxycarbonylalkyl radical, in particular a 2-alkoxycarbonylprop-2-yl radical.

A further class of disperse monoazo dyestuffs which is particularly preferably used according to the invention comprises the dyestuffs of the formula I

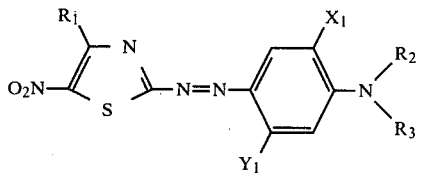

(I)

wherein $X_1$ represents hydrogen, alkyl with 1–4 C atoms, alkoxyalkyl with a total of 3 to 6 C atoms, hydroxyalkyl with 2–4 C atoms or chlorine; $Y_1$ represents chlorine, alkyl with 1–4 C atoms or —NH—CO—$Y_2$ and $R_1$, $R_2$, $R_3$ and $Y_2$ have the abovementioned meanings.

Preferred —NH—CO—$Y_2$ groups are alkanoylamino groups containing an unsubstituted alkanoyl radical with 2 to 4 C atoms, in particular acetylamino groups.

Dyestuffs which are particularly preferably used in the process according to the invention are those which have a combination of preferred characteristics, such as, for example, dyestuffs of the formula VII

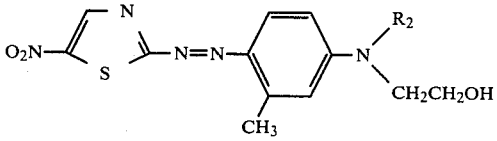

(VII)

wherein $R_2$ is ethyl or β-hydroxyethyl, or dyestuffs of the formulae

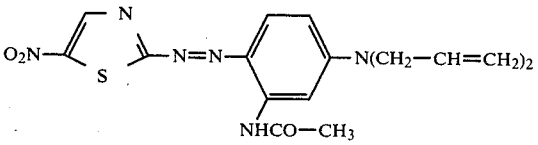

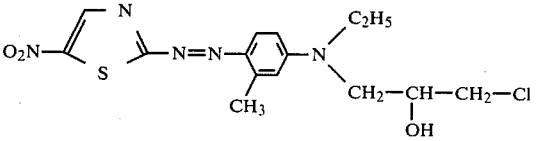

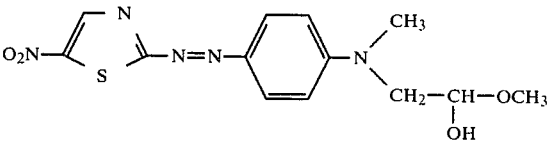

-continued

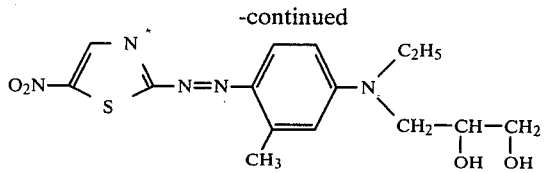

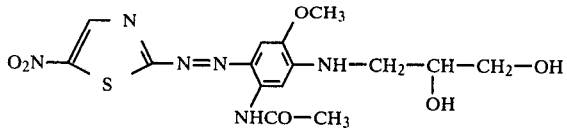

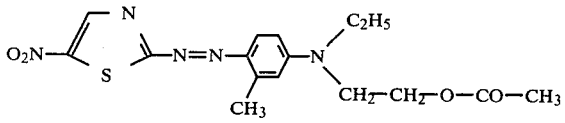

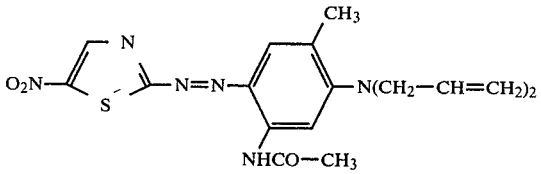

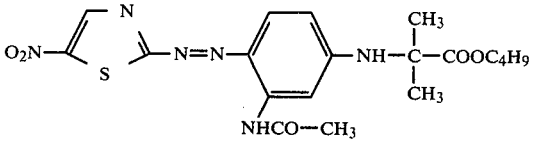

The dyestuffs of the formula II used in the process according to the invention and their manufacture are known from German Offenlegungsschrift No. 2,612,741 (*). They can exist in a number of possible tautomeric forms. For reasons of expediency, the formulae of only one of the possible forms of the dyestuffs are given. It is pointed out, however, that the invention also comprises the use of dyestuffs in each of the possible tautomeric forms.

(*)unexamined document laid open to public inspection

In the description which follows, the expressions "lower alkyl" and "lower alkoxy" relate to alkyl and alkoxy radicals with 1 to 4 carbon atoms.

Examples of substituents which can be present on the phenyl radical D are lower alkyl radicals, such as, for example, methyl, lower alkoxy radicals, such as, for example, methoxy and ethoxy, lower alkylcarbonyl radicals, such as, for example, acetyl, lower alkylsulphonyl radicals, such as, for example, ethylsulphonyl, lower alkylcarbonylamino radicals, such as, for example, acetylamino, N-lower alkyl- and N,N-di-lower alkylcarbamoyl radicals, such as, for example, N-ethylcarbamoyl, N-butylcarbamoyl and N,N-dimethylcarbamoyl, N-lower alkyl- and N,N-di-lower alkyl-sulphamoyl radicals, such as, for example, N-ethylsulphamoyl and N,N-dimethylsulphamoyl, N-lower alkyl- and N,N-di-lower alkyl-sulphamato radicals (—O.-$SO_2NH_2$), such as, for example, N-methylsulphamato and N,N-diethylsulphamato, lower alkoxycarbonyl radicals, such as, for example, methoxycarbonyl, ethoxycarbonyl, propoxycarbonyl and butoxycarbonyl, lower alkoxy-lower alkoxycarbonyl radicals, such as, for example, β-(methoxy or ethoxy)-ethoxycarbonyl, lower alkoxy-lower alkoxy-lower alkoxycarbonyl radicals, such as, for example, β-(β'-methoxy-ethoxy)ethoxycarbonyl, hydroxy-lower alkoxycarbonyl radicals, such as, for example, β-hydroxyethoxycarbonyl, hydroxy-lower alkoxy-lower alkoxycarbonyl radicals, such as, for example, γ-(β'-hydroxyethoxy)propoxycarbonyl and lower alkoxycarbonyl-lower alkyl radicals, such as, for example, ethoxycarbonylmethyl.

Examples of lower alkyl radicals $X_2$ and Z are ethyl and methyl. Examples of lower alkylcarbonyl radicals $X_2$ are acetyl and propionyl. Examples of lower alkoxycarbonyl radicals $X_2$ are methoxycarbonyl, ethoxycarbonyl, propoxycarbonyl and butoxycarbonyl. An example of a lower alkylsulphonyl radical $X_2$ is ethylsulphonyl. An example of a lower alkylcarbonylamino radical $X_2$ is acetylamino.

A preferred class of disperse monoazo dyestuffs for use according to the invention comprises the dyestuffs of the formula VIII

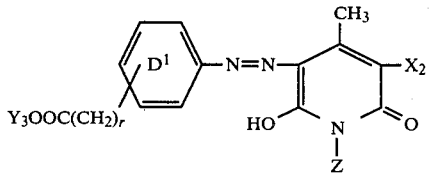

(VIII)

wherein $X_2$ and Z have the abovementioned meanings, r represents 0 or 1, $Y_3$ represents lower alkyl, lower alkoxy-lower alkyl, lower alkoxy-lower alkoxy-lower alkyl, hydroxy-lower alkyl or hydroxy-lower alkoxy-lower alkyl and the benzene ring $D^1$ can be further substituted by chlorine, bromine, nitro, lower alkoxycarbonyl, lower alkyl or lower alkoxy. Preferably, $Y_3$ represents lower alkyl, r represents 0 and $X_2$ represents —CN.

The disperse dyestuffs, to be employed according to the invention, which contain at least two carboxylic acid ester groups of the formula —$COOR_5$ and their manufacture are known from German Offenlegungsschriften Nos. 2,612,740, 2,612,742, 2,612,790, 2,612,791 and 2,612,792. In this group of dyestuffs, the radical $R_5$ contained in the carboxylic acid ester groups denotes, in particular, a cycloalkyl radical, such as, for example, cyclohexyl, a monocyclic aryl radical, such as, for example, phenyl, tolyl and xylyl, or a substituted derivative thereof, such as anisyl, chlorophenyl and bromophenyl, a monocyclic arylalkyl radical, such as, for example, benzyl and β-phenylethyl, or, preferably, an alkyl radical, such as, for example, hexyl, octyl and dodecyl, but very particularly a lower alkyl radical with 1 to 4 carbon atoms, such as, for example, ethyl, propyl, butyl and, above all, methyl. Alternatively, $R_5$ can be a substituted alkyl radical, in particular a substituted lower alkyl radical, such as, for example, a hydroxy-lower alkyl radical, for example β-hydroxyethyl, or a lower alkoxy-lower alkyl radical, for example γ-methoxypropyl. The carboxylic acid ester groups mentioned can be bonded directly to carbon atoms of one or more benzene rings or heterocyclic rings in the dyestuff molecule or to a bridge group, such as, for example, -O-alkylene or

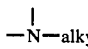

—N—alkylene.

A preferred class of such azo dyestuffs comprises dyestuffs of the formula IX

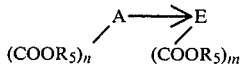

(IX)

wherein A represents the radical of a diazo component of the aromatic or heterocyclic series, E represents the radical of a coupling component, $R_5$ has the abovementioned meaning and n and m in each case independently of one another represent 0, 1 or 2, the sum of n and m being at least 2.

A second preferred class of azo dyestuffs comprises the dyestuffs of the formula IXa

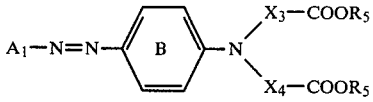

(IXa)

wherein $A_1$ represents the radical of a diazo component of the aromatic or heterocyclic series, the benzene ring B can optionally contain substituents, $R_5$ has the meaning indicated and $X_3$ and $X_4$ in each case independently of one another denote lower alkylene radicals or lower alkylene-O-lower alkylene radicals, wherein lower alkylene relates to alkylene radicals with 1 to 6 carbon atoms.

Another preferred class of azo dyestuffs comprises the dyestuffs of the formula IXb

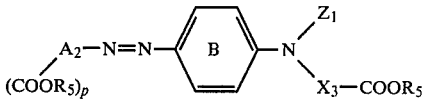

wherein B, $X_3$ and $R_5$ have the abovementioned meanings, $Z_1$ represents a hydrogen atom or an optionally substituted alkyl, cycloalkyl or aryl radical, $A_2$ represents the radical of a diazo component of the aromatic or heterocyclic series and p represents 1 or 2.

Another preferred class of azo dyestuffs comprises those of the formula IXc

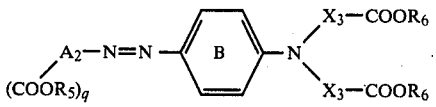

(IXc)

wherein $A_2$, B, $R_5$ and $X_3$ have the meanings indicated, $R_6$ represents lower alkyl and q represents 2 or, preferably, 1.

Examples of substituents which can be present on the benzene ring B are lower alkyl radicals, in particular methyl, lower alkoxy radicals, such as, for example, methoxy and ethoxy, and chloro-, bromo- and acylamino radicals, especially acrylamino radicals of the formulae

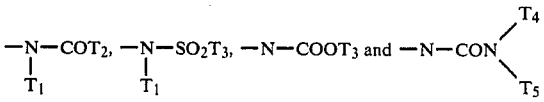

wherein $T_1$, $T_4$ and $T_5$ in each case independently of one another represent hydrogen or lower alkyl, $T_2$ represents hydrogen, lower alkyl or monocyclic aryl and $T_3$ represents lower alkyl or monocyclic aryl. The acylamino group mentioned preferably has the formula: —NHCO—lower alkyl.

In the entire description, the expressions "lower alkyl" and "lower alkoxy" relate to alkyl and alkoxy radicals with 1 to 4 carbon atoms.

The radicals of diazo components A, $A_1$ and $A_2$ can be radicals of any diazo components of the heterocyclic series, and in particular optionally substituted thiazol-2-yl, benzthiazol-2-yl, thien-2-yl, benz-2,1-isothiazol-3-yl, benz-1,2-isothiazol-3-yl, 1,2,4-thiadiazol-5-yl, 1,3,4-thiadiazol-2-yl, isothiazol-5-yl, pyrazol-3-yl, imidazol-(2 or 5)-yl, 1,2,4-triazol-3-yl and tetrazol-5-yl radicals.

In particular, A, $A_1$ and $A_2$ are radicals of a diazo component of the aromatic series, and very particularly optionally substituted naphthyl radicals and, above all, optionally substituted phenyl radicals. The substituent or substituents present on such radicals can be any substituents, with the exception of carboxylic acid groups and sulphonic acid groups, which are usually present on the diazo radicals of disperse azo dyestuffs, such as, for example, chlorine, bromine, nitro, cyano, trifluoromethyl, lower alkyl, lower alkoxy, lower alkylsulphonyl, lower alkylcarbonyl, acylamino, in particular lower alkylcarbonylamino, sulphonamido and N-substituted and N,N-disubstituted derivatives thereof, carboxamido and N-substituted and N,N-disubstituted derivatives thereof, and carboxylic acid ester groups, in particular lower alkoxycarbonyl. A, $A_1$ and $A_2$ are preferably optionally substituted phenyl radicals, and in particular radicals of the formulae

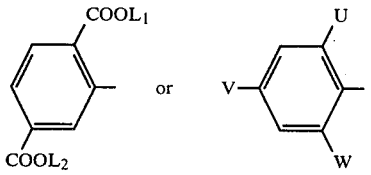

wherein $L_1$ and $L_2$ in each case independently of one another represent lower alkyl, U and W in each case independently of one another represent hydrogen, lower alkyl, chlorine, bromine, lower alkoxy, nitro, cyano or lower alkoxycarbonyl and V represents hydrogen, nitro, chlorine, bromine, lower alkyl, lower alkoxy, cyano, lower alkoxycarbonyl, sulphonamido or carboxamido or N- and N,N-substituted derivatives thereof, lower alkylcarbonyl or lower alkylsulphonyl. V is preferably nitro.

In the above classes, A, $A_1$ and $A_2$ preferably represent a phenyl radical which can contain up to 3 substituents, preferably the substituents which have been listed above as examples of substituents on the diazo radical mentioned.

A particular group of azo disperse dyestuffs containing carboxylic acid ester groups corresponds to the formula IXd

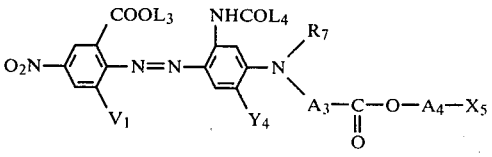

(IXd)

wherein $L_3$ represents optionally substituted lower alkyl; $L_4$ represents optionally substituted lower alkyl or optionally substituted amino; $V_1$ represents hydrogen or nitro; $Y_4$ represents hydrogen or lower alkoxy; $R_7$ represents lower alkyl or cyano-lower alkyl; $A_3$ and $A_4$ in each case independently of one another represent lower alkylene; and $X_5$ represents cyano, lower alkoxy, lower alkoxy-lower alkoxy, lower alkoxy-lower alkoxy-lower alkoxy, chlorine, bromine, lower alkoxy-carbonyl, lower alkylcarbonyl, optionally substituted phenoxycarbonyl, optionally substituted phenylcarbonyl, optionally substituted phenoxy, hydroxymethyl or lower alkylcarbonyloxymethyl.

In the entire description, the expressions "lower alkyl", "lower alkoxy" and "lower alkylene" relate to alkyl, alkoxy and alkylene radicals with 1 to 4 carbon atoms.

Examples of lower alkylene radicals $A_3$ and $A_4$ are methylene, trimethylene, tetramethylene, propylene and, above all, ethylene. Examples of cyano-lower alkyl radicals $R_7$ are cyanomethyl, γ-cyanopropyl, δ-cyanobutyl and, above all, β-cyanoethyl. Examples of lower alkyl radicals $L_3$, $L_4$ and $R_7$ are methyl, ethyl, n-propyl and n-butyl. Examples of lower alkoxy radicals $Y_4$ are ethoxy and, above all, methoxy.

Examples of substituted lower alkyl radicals $L_3$ and $L_4$ are hydroxy-lower alkyl, such as, for example, β-hydroxyethyl, chloro-lower alkyl, such as, for example, β-chloroethyl, cyanolower alkyl, such as, for example, β-cyanoethyl, lower alkoxylower alkyl, such as, for example, β-ethoxyethyl and γ-methoxypropyl, phenyl-lower alkyl, such as, for example, benzyl and β-phenylethyl, and phenoxy-lower alkyl, such as, for example, phenoxymethyl.

Examples of substituted amino groups $L_4$ are lower alkylamino, such as, for example, methylamino and ethylamino.

However, $L_3$ preferably represents lower alkyl. Furthermore, $L_4$ preferably represents lower alkyl, in particular methyl.

Specific examples of groups $X_5$ are loer alkoxy radicals, such as, for example, methoxy, ethoxy, n-propoxy and n-butoxy, lower alkoxy-lower alkoxy radicals, such as, for example, β-ethoxyethoxy and γ-methoxypropoxy, lower alkoxy-lower alkoxy-lower alkoxy radicals, such as, for example, β-(β'-methoxyethoxy)ethoxy, lower alkoxycarbonyl radicals, such as, for example, methoxycarbonyl, ethoxycarbonyl and n-butoxycarbonyl, lower alkylcarbonyl radicals, such as, for example, acetyl and propionyl, optionally substituted phenoxycarbonyl radicals, such as, for example, phenoxycarbonyl itself, p-methylphenoxycarbonyl and m-chlorophenoxycarbonyl, optionally substituted phenylcarbonyl radicals, such as, for example, benzoyl and m-nitrobenzoyl, optionally substituted phenoxy radicals, such as, for example, phenoxy itself, tolyloxy and chlorophenoxy, and lower alkylcarbonyloxymethyl radicals, such as, for example, acetoxymethyl.

However, $X_5$ preferably represents cyano, lower alkoxy, lower alkoxy-lower alkoxy, lowr alkoxycarbonyl, lower alkylcarbonyl, hydroxymethyl or lower alkylcarbonyloxymethyl.

A preferred class of dyestuffs according to the invention comprises those of the formula IXe

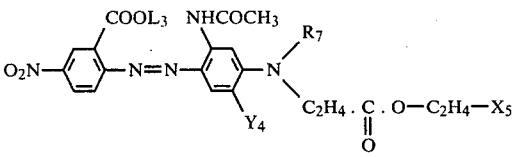

(IXe)

wherein $R_7$ has the meaning indicated; $L_3$ represents lower akyl; $Y_4$ represents hydrogen or methoxy; and $X_5$ represents cyano, lower alkoxy, lower alkoxy-lower alkoxy, lower alkoxycarbonyl, lower alkylcarbonyl, hydroxymethyl or lower alkylcarbonyloxymethyl.

Another particular group of azo disperse dyestuffs containing carboxylic acid ester groups corresponds to the formula IXf

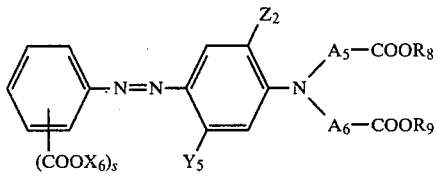

(IXf)

wherein $X_6$ represents lower alkyl, s represents 1, 2 or 3, $Z_2$ represents hydrogen, lower alkyl or lower alkoxy, $Y_5$ represents hydrogen, lower alkyl, lower alkoxy, chlorine, bromine, —$NHCOX_7$ or —$NHSO_2X_8$, $X_7$ represents lower alkyl, lower alkoxy, amino or N-lower alkylamino, $X_8$ represents lower alkyl, $A_5$ and $A_6$ in each case independently of one another represent lower alkylene and Rhd 8 and $R_9$ in each case independently of one another represent lower alkyl or hydroxyalkyl with 2 to 4 carbon atoms.

Examples of lower alkyl radicals $X_6$, $Z_2$, $Y_5$, $X_7$, $X_8$, $R_8$ and $R_9$ are methyl, ethyl, n-propyl, isopropyl and n-butyl. Examples of lower alkoxy radicals $X_7$, $Z_2$ and $Y_5$ are ethoxy and, preferably, methoxy. Examples of lower alkylene radicals $A_5$ and $A_6$ are methylene, trimethylene, propylene, tetramethylene, hexamethylene and, above all, ethylene. Examples of hydroxyalkyl radicals $R_8$ and $R_9$ are β-hydroxyetyl, β- or γ-hydroxypropyl and β-, γ- or δ-hydroxybutyl. Examples of N-lower alkylamino radicals $X_7$ are methylamino and ethylamino.

A preferred class of dyestuffs according to the invention comprises those of the formula IXg

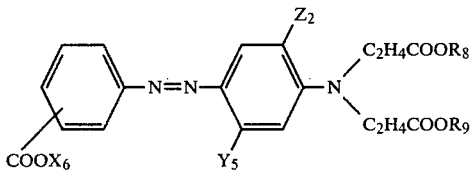

(IXg)

wherein $X_6$, $Y_5$, $Z_2$, $R_8$ and $R_9$ have the abovementioned meanings. $Y_5$ preferably represents hydrogen or lower alkylcarbonylamino.

Another particular group of azo disperse dyestuffs containing carboxylic acid ester groups corresponds to the formula IXh

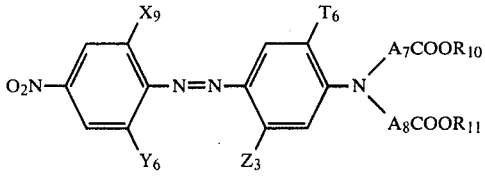

(IXh)

wherein $X_9$ represents nitro or cyano; $Y_6$ represents hydrogen, chlorine, bromine, cyano, nitro, lower alkoxy or lower alkoxycarbonyl; $T_6$ represents methoxy or ethoxy; $Z_3$ represents hydrogen, chlorine, bromine, lower alkyl or lower alkoxy; $A_7$ and $A_8$ in each case independently of one another represent lower alkylene; and $R_{10}$ and $R_{11}$ in each case independently of one another represent lower alkyl or hydroxyalkyl with 2 to 4 carbon atoms.

Examples of lower alkyl radicals $Z_3$, $R_{10}$ and $R_{11}$ are methyl, ethyl, n-propyl and n-butyl. Examples of lower alkoxy radicals $Y_6$ and $Z_3$ are methoxy and ethoxy. Examples of lower alkoxycarbonyl radicals $Y_6$ are methoxycarbonyl, ethoxycarbonyl, n-propoxycarbonyl, n-butoxycarbonyl, isopropoxycarbonyl, sec.-butoxycarbonyl and isobutoxycarbonyl.

Examples of hydroxyalkyl radicals $R_{10}$ and $R_{11}$ are β-hydroxyethyl, γ-hydroxypropyl and δ-hydroxy-n-butyl. Examples of lower alkylene radicals $A_7$ and $A_8$ are methylene, trimethylene, propylene, tetramethylene, hexamethylene, α,β-dimethylethylene and, above all, ethylene.

A preferred class of dyestuffs according to the invention comprises those of the formula IXi

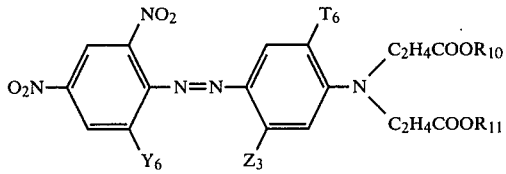

(IXi)

wherein $Y_6$ represents hydrogen, chlorine, bromine, nitro or cyano and $Z_3$, $T_6$, $R_{10}$ and $R_{11}$ have the abovementioned meanings.

Another particular group of azo disperse dyestuffs containing carboxylic acid ester groups corresponds to the formula IXk

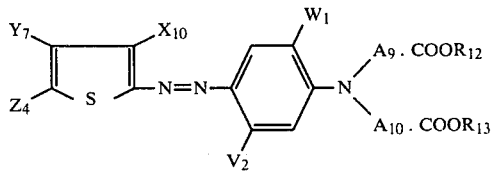

(IXk)

wherein $X_{10}$ represents cyano, optionally substituted methoxycarbonyl, optionally substituted ethoxycarbonyl, optionally substituted carboxamido, lower alkylcarbonyl, lower alkylsulphonyl, optionally substituted arylcarbonyl or arylsulphonyl, chlorine or bromine; $Y_7$ represents hydrogen, lower alkyl, optionally substituted aryl or lower alkoxycarbonyl; $Z_4$ represents hydrogen, lower alkyl, chlorine, bromine, nitro, cyano, optionally substituted lower alkoxycarbonyl or optionally substituted carboxamido, with the restriction that $X_{10}$ and $Z_4$ do not both represent optionally substituted carboxamido and that $Y_7$ and $Z_4$ do not both represent hydrogen; $W_1$ represents hydrogen, lower alkyl or lower alkoxy; $V_2$ represents hydrogen, chlorine, bromine, lower alkyl, lower alkoxy or acylamino, with the restriction that $V_2$ and $W_1$ do not both represent hydrogen; $A_9$ and $A_{10}$ in each case independently of one another represent lower alkylene; and $R_{12}$ and $R_{13}$ in each case independently of one another represent lower alkyl or hydroxy-lower alkyl.

The optionally substituted carboxamido groups $X_{10}$ and $Z_4$ have the formula:

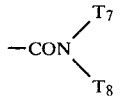

wherein $T_7$ represents hydrogen, lower alkyl or phenyl and $T_8$ represents hydrogen or lower alkyl.

Examples of lower alkyl radicals $Z_4$, $Y_7$, $T_7$, $T_8$, $V_2$, $W_1$, $R_{12}$ and $R_{13}$ are methyl, ethyl, n-propyl and n-butyl. Examples of lower alkoxy radicals $V_2$ and $W_1$ are ethoxy and, preferably, methoxy. Examples of lower alkylene radicals $A_9$ and $A_{10}$ are methylene, trimethylene, propylene, tetramethylene and, above all, ethylene. The acylamino groups $V_2$ preferably have the formula —$NHCOT_9$ or —$NHSO_2T_{10}$, wherein $T_9$ represents hydrogen or lower alkyl and $T_{10}$ represents lower alkyl. The acylamino groups mentioned preferably have the formula —$NHCOT_9$, whereby $T_9$ represents lower alkyl. Specific examples of acrylamino groups $V_2$ are methylsulphonylamino, benzenesulphonylamino, benzoylamino, ureido, formylamino and, preferably, acetylamino, propionylamino and butyrylamino.

Examples of lower alkoxycarbonyl radicals (carbo-lower alkoxy radicals) $Y_7$ and $Z_4$ are methoxycarbonyl and ethoxycarbonyl. Examples of substituted lower alkoxycarbonyl radicals $Z_4$ are hydroxy-lower alkoxycarbonyl, such as, for example, β-hydroxyethoxycarbonyl, cyano-lower alkoxycarbonyl, such as, for example, β-cyanoethoxycarbonyl, lower alkoxy-lower alkoxycarbonyl, such as, for example, β-methoxyethoxycarbonyl and lower alkoxy-lower alkoxy-lower alkoxycarbonyl, such as, for example, β-(β'-methoxyethoxy)ethoxycarbonyl. Examples of substituted methoxycarbonyl and ethoxycarbonyl radicals $X_{10}$ are cyanomethoxycarbonyl, β-cyanoethoxycarbonyl, β-chloroethoxycarbonyl and β-(methoxy or ethoxy)-ethoxycarbonyl. Examples of lower alkylcarbonyl and lower alkylsulphonyl radicals $X_{10}$ are acetyl, methylsulphonyl and ethylsulphonyl. Examples of optionally substituted arylcarbonyl and arylsulphonyl radicals $X_{10}$ are optionally substituted benzoyl and phenylsulphonyl radicals, in particular nitrobenzoyl, methylbenzoyl, methoxybenzoyl, nitrobenzoyl and p-tolylsulphonyl. Examples of optionally substituted aryl radicals $Y_7$ are phenyl, nitrophenyl and nitrotolyl.

A preferred class of dyestuffs according to the invention comprises those of the formula IX 1

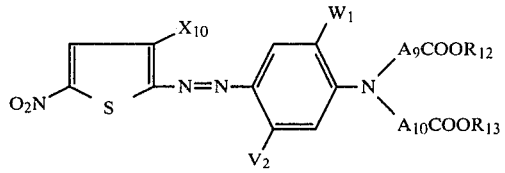

(IX 1)

wherein $X_{10}$ represents cyano, methoxycarbonyl or ethoxycarbonyl and $W_1$, $V_2$, $A_9$, $A_{10}$, $R_{12}$ and $R_{13}$ have the abovementioned meanings.

Examples of disperse dyestuffs, which contain carboxylic acid ester groups and are to be employed according to the invention, of the anthraquinone series are: 1,4-di-(β-ethoxycarbonylethylamino)-anthraquinone, 1-amino-4-[4'-(α,β-di-{β'-hydroxyethoxycarbonyl}ethyl)anilino]anthraquinone, 1,4-di(β-methoxycarbonylethylamino)anthraquinone and 1,4-di-(o-methoxycarbonylanilino)anthraquinone.

The reactive dyestuffs employed in the process according to the invention contain one of the abovementioned fibrereactive radicals of the formulae III to IV. It is common to the radicals of the formulae III to V that they form a vinylsulphonyl group in the presence of alkali, a sulphate or halide anion being split off. This group formed in the presence of alkali fixes the dyestuff by addition of one of the OH groups of the cellulose to the vinyl double bond, in the same way as the vinylsulphonyl radical of the formula VI which is bonded directly to the dyestuff radical. Reactive dyestuffs which contain one of the abovementioned reactive radicals can belong to any of the industrially important groups of dyestuffs. Examples which may be mentioned of reactive dyestuffs which are suitable for carrying out the process according to the invention are the monoazo dyestuffs CI Yellow 13–17 and 72–74, Orange 7, 15, 16, 23, 24 and 55, Red 21–23, 35, 36, 50, 63, 103–107 and 112–114, Blue 28 and Brown 16; the disazo dyestuffs CI Blue 76, Blue 98 and Black 5 and 31; the monoazo or disazo metal complex dyestuffs CI Violet 4 and 5, Blue 20 and Brown 18; the anthraquinone dyestuffs CI Violet 22 and Blue 19 and 27; and the phthalocyanine dyestuffs CI Blue 21, 38, 77 and 91 and Green 14.

Dischargeable reactive dyestuffs which are particularly preferred are those which contain, as the reactive anchor, at least one fibre-reactive radical of the formula IV or V.

The amount of dyestuffs which the padding liquors to be employed according to the invention contain is determined, as is customary, by the depth of colour of the desired dyeing and intensity of the resist effect. In addition, the amount of dyestuffs suitable for one of the types of fibre participitating also corresponds to the proportion of this type of fibre in the entire fibre composition. Thus, a padding liquor which is prepared for a background dyeing of a particular colour shade contains, in the case where the substrate contains predominantly cellulose fibres, a high proportion of dischargeable and, if appropriate, non-dischargeable reactive dyestuffs and a low proportion of dischargeable and, if appropriate, non-dischargeable disperse dyestuffs, and in the case where the substrate contains predominantly polyester fibres, a high proportion of the disperse dyestuffs and a low portion of the reactive dyestuffs.

The process according to the invention is, according to its nature, predominantly intended for finishing textiles of cellulose/polyester fibres. However, taking into consideration the abovementioned criteria for the composition of the padding liquor, there is no restriction on the ratio of the two types of fibre, and in the limiting case, the process can also be employed for producing resist effects on pure cellulose textiles or pure polyester textiles, the padding liquors then containing exclusively dischargeable and, if appropriate, nondischargeable reactive dyestuffs or exclusively dischargeable and, if appropriate, non-dischargeable disperse dyestuffs.

The resist paste to be employed in carrying out the process according to the invention contains, as the resisting agent, either an alkali metal sulphite or an alkali metal bisulphite, in combination with an alkali metal carbonate or alkali metal bicarbonate. All or some of the alkali metal bisulphite can also be replaced by an equivalent amount of an alkali metal bisulphite-aldehyde adduct. It is also possible to produce this adduct in the resist paste itself, by adding an alkali metal bisulphite, alkali metal bicarbonate and an aldehyde to the resist paste. Suitable alkali metal sulphites, alkali metal bisulphites and alkali metal bicarbonates for use in industry are, in particular, the sodium or potassium salts, preferaly the sodium salts. Possible aldehydes which the resist pastes can contain as alkali metal bisulphite adducts are, in principle, all those which are readily accessible industrially, such as, for example, formaldehyde, acetaldehyde, glyoxal and benzaldehyde. Since the aldehyde-alkali metal bisulphite adducts are in equilibrium with the individual components of the adduct, those aldehydes which, in the free state, do not have too high a vapour pressure and thus cannot give rise to odour nuisances are preferred. Glyoxal, for example, is particularly suitable for use according to the invention.

In the case of the preparation of printing pastes which contain sodium bisulphite in combination with an aldehyde, the use of separately prepared addition compounds of these two components offers particular advantages. Thus, for example, the troublesome foaming which can occur in unfavourable cases during the manufacture of printing pastes containing an alkali metal bicarbonate can be avoided by using such an adduct. The concentration of the resisting agent in the printing pastes is appropriately 25 to 250 g/kg, preferably 50 to 130 g/kg, calculated relative to sodium bisulphite.

In addition to the resisting agents mentioned, the resist pastes contain the customery additives contained in printing pastes for textiles, in particular thickeners, such as, for example, alginates, starch products and synthetic polymeric thickeners, mineral oils, hydrotropic substances, such as, for example, urea, and additives which promote wetting, penetration and absorption of the dyestuff. The presence of non-ionic detergents, which the discharge printing pastes can appropriately contain, is particularly favourable for the discharge operation. Non-ionic detergents which are employed in customery discharge printing pastes are, for example, glycerol and/or polyglycols, such as polyethylene glycol with an average molecular weight of 300 to 400.

It has now been found that it is particularly favourable with regard to the fixing of the non-discharged dyestuffs not to use these additives contained in the known printing pastes but instead to employ esters of higher-molecular polyglycols with carboxylic acids. The use of polyglycol esters has a particularly advantageous effect when coloured discharges are to be produced, that is to say when disperse dyestuffs and reactive dyestuffs which are stable towards the resisting agent are also used in the background dyeing at the point printed with the resist paste or are contained in the resist paste.

Polyglycol carboxylic acid esters which can particularly advantageously be employed in the resist pastes to be used according to the invention are described, for exaple, in German Auslegeschrift No. 1,138,735.

The process according to the invention is carried out in a manner which is in itself known, in which the textile material of polyester fibres and cellulose fibres is padded with dye liquors which contain one or more of the abovementioned disperse dyestuffs which are dischargeable under alkaline conditions and one or more reactive dyestuffs which possess one of the abovementioned reactive radicals of the formulae III to VI, preferably the $\beta$-sulphatoethylsulphonyl or $\beta$-sulphatoethylsulphonamide groups, in addition to the known customary dyeing auxiliaries, such as, for example, dispersing agents, wetting agents, anti-foam agents and padding auxiliaries, and, if coloured discharge prints are to be produced, in addition disperse dyestuffs and reactive dyestuffs which are resistant towards the discharge agent, and the padded webs of fabric are squeezed off to a liquor pick-up of 50–120%. The fabric webs are then dried by warm air, if necessary with prior irradiation with infra-red light, the temperature being about 80° to at most about 150° C., with the time correspondingly shortened. The fabric webs thus prepared are then printed with the discharge resist printing paste, which contains the resisting agents described above and the additives known in printing pastes for textile printing, in particular thickeners. The padded and printed textile sheet-like structures are then subjected to heat treatment between 100° and 190° C. Heat is preferably supplied by super-heated steam. The heat treatment causes (a) at the points printed with the resist paste, an inhibition of the resistable disperse dyestuffs and reactive dyestuffs and fixing of the non-resistable disperse dyestuffs and reactive dyestuffs which may be present, and (b) at the points which are not printed with the resist paste, fixing of the disperse dyestuffs and, if the padding liquor contained an alkali metal formate, at the same time also of the reactive dyestuffs. In this context, inhibition of the dyestuff is to be understood as the change in the dyestuff molecule caused by the resisting agent, which results in the dyestuff concerned no longer staining the substrate. In the case of the two-phase processes, that is to say if the padding liquor contained no alkali metal formate, fixing of the reactive dyestuffs in the background dyeing, that is to say at the points which have not been printed with the resist paste, is then carried out.

Finally, the dyeings or prints are rinsed hot and cold and dried. A particular embodiment of the process according to the invention consists of a procedure in which the padding liquor, in addition to resistable disperse dyestuffs and reactive dyestuffs, also contains those which are stable towards the resisting agent and thus are not destroyed by the discharge resist printing pastes to be employed according to the invention. If the procedure is otherwise as indicated above, multicoloured designs are obtained. A further embodiment of the process according to the invention consists of a procedure in which the resistable dyestuffs are not applied to the whole fabric by padding with a padding liquor but are likewise printed onto the fabric in the form of printing pastes and then cover-printed with the discharge resist printing paste. Fixing and finishing of the textile prints are then carried out as already described above. In this process also, it is possible to add to the colour printing pastes first printed on dyestuffs which are stable towards the resisting agent. In this case also, multi-coloured designs are obtained. Another possibility for carrying out the process according to the invention is a procedure in which discharge resist printing pastes, which in turn contain dyestuffs which are stable towards the resisting agent, are printed onto the background padded or printed with resistable dyestuffs. On subsequent fixing and finishing of the textile materials as described above, multi-coloured designs are also obtained in this case.

The disperse dyestuffs of the formula I are present in the padding liquors or in the printing pastes in a finely dispersed form, as is customary and known for disperse dyestuffs, whilst the reactive dyestuffs are dissolved. The padding liquors or printing pastes which are to be employed according to the invention are also prepared in a manner which is in itself known, by mixing the constituents of the liquor or printing paste with the required amount of water and liquid, finely dispersed or solid, redispersible formulations of the disperse dyestuffs and solutions or formulations of the reactive dyestuffs.

Disperse dyestuffs which are stable towards the resisting agent and can be combined with the resistable dyestuff of the formula I to produce multi-coloured designs are the known commercially available dyestuffs from the group comprising the azo or azomethine dyestuffs, quinophthalone dyestuffs, nitro dyestuffs and anthraquinone dyestuffs. Some examples of stable disperse dyestuffs are:

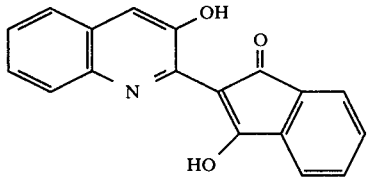

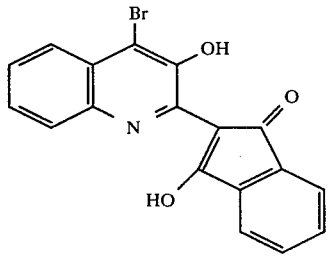

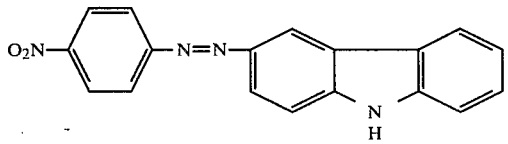

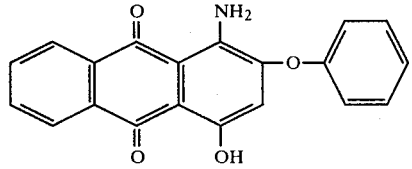

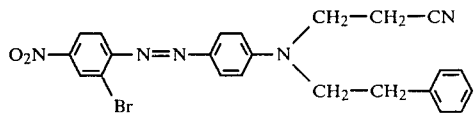

-continued

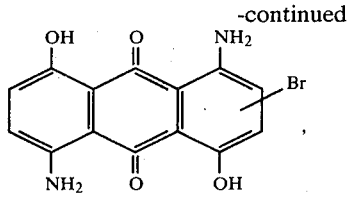

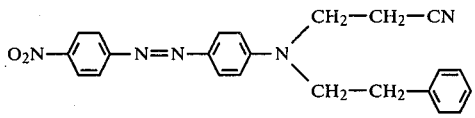

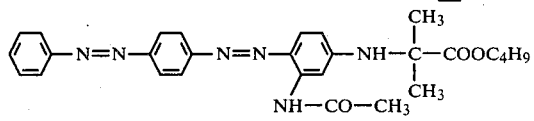

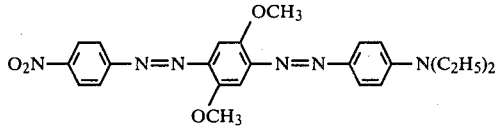

Reactive dyestuffs which are stable towards the resisting agent and can be combined with the resistable reactive dyestuff of the formula I to produce multi-coloured designs are the known commercially available dyestuffs from the group comprising the azo or azomethine dyestuffs, quinophthalone dyestuffs, nitro dyestuffs and anthraquinone dyestuffs which contain, as the fibre-reactive radical, a radical from the triazine, quinoxaline, phthalazine, pyridazine, pyrimidine or $\alpha,\beta$-unsaturated aliphatic carboxylic acid class. In the following text, the most important compounds from which the fibre-reactive radicals of the non-resisted reactive dyestuffs, that is to say to reactive dyestuffs which are stable towards the discharge agent, are derived are mentioned as representatives of the entire class: cyanuric chloride, cyanuric bromide, cyanuric fluoride, dihalogeno-mono-amino-triazines, such as 2,6-dichloro-4-aminotriazine, 2,6-dichloro-4-methylamino-triazine, 2,6-dichloro-4-hydroxyethyl-aminotriazine, 2,6-dichloro-4-phenylaminotriazine, 2,6-dichloro-4-(o-, m- or p-sulphophenyl)-aminotriazine, dihalogenoalkoxy- and -aryloxy-sym.-triazines, tetrahalogenopyrimidines, 2,4,6-trihalogenopyrimidines, derivatives of heterocyclic carboxylic acids or sulphonic acids, such as 3,6-dichloropyridazine-4-carboxylic acid chloride, 2,4-dichloropyrimidine-5-carboxylic acid chloride, 2,4,6-trichloropyrimidine-5-carboxylic acid chloride, 4,5-dichloro-6-pyridazonylpropionyl chloride, 1,4-dichlorophthalazine-6-carboxylic acid chloride, 5,6-dichloro-4-methyl-2-methylsulphonyl-pyrimidine, 2- or 3-monochloroquinoxaline-6-carboxylic acid chloride or -6-sulphonic acid chloride, 2,3-dichloroquinoxaline-6-carboxylic acid chloride or -6-sulphonic acid chloride, 1,4-dichlorophthalazine-6-carboxylic acid chloride or -6-sulphonic acid chloride, 2,4-dichloroquinazoline-6- or -7-carboxylic acid chloride or -sulphonic acid chloride, 2-chlorobenzthiazole-5- or -6-carboxylic acid chloride or -5- or -6-sulphonic acid chloride, 2-methylsulphonyl- or 2-ethylsulphonyl- or 2-phenylsulphonylbenzthiazole-5- or -6-sulphonic acid chloride, acrylic acid chloride and 3-chloropropionic acid chloride.

Where solutions of substances are employed in the following examples, they are aqueous solutions, unless another solvent is expressly indicated. Percentage data are percentages by weight.

EXAMPLE 1

A mercerised mixed fabric of polyester/cotton 50:50 is padded with a liquor consisting of 20 parts by weight of the liquid commercial form of 5-(4-nitro-2-methylphen-1-yl)-azo-4-methyl-3-cyano-2,6-dihydroxypyridine, 20 parts by weight of the liquid commercial form of C.I. Disperse Violet 48, 40 parts by weight of the commercial form of a mixture of 40% by weight of C.I. Reactive Yellow 17 and 60% by weight of C.I. Reactive Violet 5, 200 parts by weight of water at 80° C., 687 parts by weight of cold water, 10 parts by weight of sodium m-nitrobenzenesulphonate, 20 parts by weight of an antimigration agent based on polyacrylic acid and 3 parts by weight of monosodium phosphate. The fabric is dried carefully at 80° to 100° C. in a hot flue and cover-printed, by the screen-printing process, with a printing paste which is prepared as follows: 30 parts by weight of the commercial form of C.I. Reactive Red 24, 30 parts by weight of the liquid commercial form of C.I. Disperse Red 132, 100 parts by weight of urea and 10 parts by weight of sodium m-nitrobenzenesulphonate are dissolved in 150 parts by weight of water of 80° C. This solution is stirred into 500 parts by weight of a stock thickener which contains 230 parts by weight of an aqueous 4% strength alginate thickener, 80 parts by weight of an aqueous 10% strength starch ether thickener, 85 parts by weight of water, 25 parts by weight of an aqueous 10% strength solution of the condensation product of polyglycol 2,000 with stearic acid and 80 parts by weight of heavy petrol. 100 parts by weight of discharge resist, which has been prepared beforehand by mixing 65 parts by weight of a 40% strength aqueous glyoxal solution, 310 parts by weight of sodium bisulphite solution of 38° Be strength, 125 parts by weight of water and 500 parts by weight of sodium bicarbonate, are then also added. After drying, the fabric is steamed at 175° C. in a high-temperature steamer for 7 minutes, padded with a fixing solution consisting of 700 parts by volume of water, 150 parts by volume of sodium carbonate, 150 parts by volume of sodium chloride, 100 parts by volume of sodium hydroxide solution of 38° Be strength and 50 parts by volume of potassium carbonate (the solution is adjusted to 1,000 parts by volume with water) and steamed at 110°–115° C. in a flash ager for 10 seconds. The fabric is then rinsed cold, after-treated at 40°, 60° and 80° C. with 2 g/l of an auxiliary based on a fatty acid polyglycol ester, rinsed and dried.

Red colour effects on a brown background are obtained.

EXAMPLE 2

A causticised mixed fabric of polyester/viscose staple 70:30 is padded with the dye liquor described in Example 1, dried carefully at 80°–100° C. in a hot flue and over-printed, by the screen-printing process, with a printing paste consisting of 40 parts by weight of the liquid commercial form of C.I. Disperse Red 200, 30 parts by weight of the commercial form of C.I. Reactive Red 33, 80 parts by weight of urea, 274 parts by weight of water of 80° C., 10 parts by weight of sodium m-nitrobenzenesulphonate, 500 parts by weight of the stock thickener according to Example 1, 30 parts by weight of sodium carbonate, 30 parts by weight of sodium bisulphite solution of 38° Be strength and 6 parts by weight of 40% strength glyoxal solution. After drying, the fabric is steamed for 7 minutes in saturated steam in order to intensify the resist effect, and the disperse dyestuffs and the reactive dyestuffs which are resistant towards alkali metal sulphites are then fixed at 185° C. in a high-temperature steamer for 6 minutes. To fix the background dyeing, the fabric is then padded with the fixing solution indicated in Example 1, and is steamed at 110°–115° C. for 10 seconds and finished as indicated in Example 1.

Scarlet colour effects on a brown background are obtained.

EXAMPLE 3

A mercerised mixed fabric of polyester/cotton 65:35 is padded with a batch consisting of 100 parts by weight of a 20% strength liquid formulation of the dyestuff of the formula

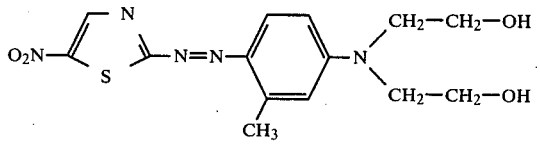

40 parts by weight of the liquid commercial form of C.I. Reactive Blue 122, 808 parts by weight of cold water, 10 parts by weight of sodium m-nitrobenzenesulphonate, 20 parts by weight of an antimigration agent based on polyacrylic acid, 2 parts by weight of monosodium phosphate and 20 parts by weight of sodium formate.

The fabric is dried carefully at 80°–100° C. in a hot flue and cover-printed, by the screen-printing process, with a printing paste consisting of 25 parts by weight of the commercial form of 1-[5-(3,6-dichloropyridazin-4-yl-carbonylamino)-2-methyl-3-sulphophenyl]-3-carboxy-4-(2-sulphophenyl-azo)-5-pyrazolone, 40 parts by weight of the liquid commercial form of C.I. Disperse Yellow 63, 150 parts by weight of urea, 199 parts by weight of cold water, 10 parts by weight of sodium m-nitrobenzenesulphonate, 500 parts by weight of the stock thickener according to Example 1, 40 parts by weight of sodium bicarbonate, 30 parts by weight of sodium bisulphite solution of 38° Be strength and 6 parts by weight of 40% strength glyoxal solution.

After drying, the dyestuffs are fixed at 175° C. with superheated steam for 7 minutes and the fabric is after-treated as indicated in Example 1.

Yellow colour effects on a navy blue base are obtained.

EXAMPLE 4

A causticised mesh fabric of polyester/COLVERA 70:30 is padded with the following dye liquor: 50 parts by weight of the liquid commercial form of C.I. Disperse Red 278, 40 parts by weight of the commercial form of C.I. Reactive Red 63, 200 parts by weight of water of 80° C., 660 parts by weight of cold water, 10 parts by weight of sodium m-nitrobenzenesulphonate, 20 parts by weight of an antimigration agent based on polyacrylic acid and 20 parts by weight of sodium formate.

The fabric is dried carefully at 80°–100° C. in a hot flue and cover-printed, by the screen-printing process, with a printing paste consisting of 30 parts by weight of the commercial form of 1-[5-(3,6-dichloropyridazin-4-yl-carbonylamino)-3-sulpho-2,4,6-trimethylphenylamino]-3-sulpho-4-amino-anthraquinone, 50 parts by weight of the liquid commercial form of C.I. Disperse Blue 73, 200 parts by weight of urea, 102 parts by weight of water of 80° C., 10 parts by weight of sodium m-nitrobenzenesulphonate, 500 parts by weight of the stock thickener according to Example 1, 50 parts by weight of sodium bicarbonate, 50 parts by weight of sodium bisulphite solution of 38° Be strength and 8 parts by weight of a 40% strength glyoxal solution.

After drying, the dyestuffs are fixed at 175° C. with superheated steam for 7 minutes and the fabric is after-treated as indicated in Example 1.

Blue colour effects on a red base are obtained.

EXAMPLE 5

A mixed fabric of polyester and mercerised cotton in the ratio 65:35 is padded with a dye liquor consisting of 150 parts by weight of a 20% strength liquid formulation of the dyestuff of the formula

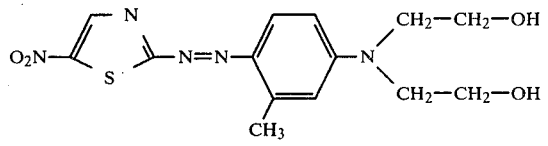

40 parts by weight of the commercial form of C.I. Reactive Blue 122, 767 parts by weight of water, 3 parts by weight of sodium chlorate, 20 parts by weight of an antimigration agent based on polyacrylic acid and 20 parts by weight of sodium formate. The fabric is dried carefully at 80°-100° C. in a hot flue and cover-printed, by the roller printing process, with a printing paste consisting of 60 parts by weight of the dyestuff of the formula

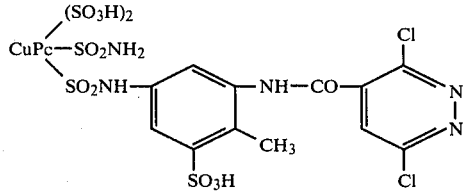

60 parts by weight of the liquid commercial form of C.I. Disperse Blue 87, 255 parts by weight of water, 600 parts by weight of a 4% strength solution of a sodium alginate and 25 parts by weight of sodium sulphite.

After drying, the dyestuffs are fixed at 175° C. with superheated steam for 7 minutes and the fabric is after-treated as indicated in Example 1.

Turquoise colour effects on a navy blue background are obtained.

EXAMPLE 6

A mercerised mixed fabric of polyester/cotton 65:35 is padded with a batch consisting of: 50 parts by weight of the liquid commercial form of 5-(4-nitro-2-methylphen-1-yl)-azo-4-methyl-3-cyano-2,6-dihydroxypyridine, 40 parts by weight of the commercial form of C.I. Reactive Yellow, 867 parts by weight of water, 3 parts by weight of sodium chlorate, 20 parts by weight of an antimigration agent based on polyacrylic acid and 20 parts by weight of sodium formate. The fabric is dried carefully in a hot flue at 80°-100° C. and cover-printed by the roller printing process with a printing paste consisting of 60 parts by weight of the commercial form of C.I. Reactive Red 24, 40 parts by weight of the liquid commercial form of C.I. Disperse Red 132, 275 parts by weight of water, 600 parts by weight of a 4% strength solution of a sodium alginate and 25 parts by weight of sodium sulphite.

After drying, the dyestuffs are fixed at 175° C. with super-heated steam for 7 minutes and after-treated as indicated in Example 1.

Brilliant red colour effects on a yellow background are obtained.

We claim:

1. In the process for production of resist effects on textile materials of mixed fibers of polyester and cellulose comprising impregnating the materials with a dye liquor containing disperse dyestuffs and reactive dyestuffs which react with the resisting agents, drying or partially drying the padded materials and subsequently printing a resist paste on the material, and heat-treating the materials the improvement comprises the dischargeable disperse dyestuffs being of the formula

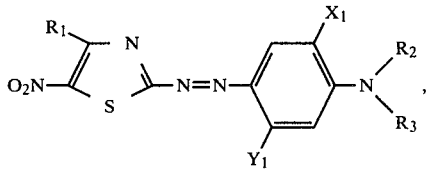

one of the tautomeric forms of the formula,

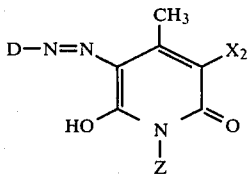

or disperse dyestuffs which are free from groups conferring solubility in water and which contain at least two carboxylic acid ester moieties wherein $R_1$ is hydrogen, alkyl with 1-6 carbon atoms, cyano, trifluoromethyl or unsubstituted or substituted phenyl, the substituent being selected from the group consisting of chlorine, bromine, nitro and alkyl with 1-4 carbon atoms;

$X_1$ is hydrogen, chlorine, bromine, alkoxy with 1-4 carbon atoms, hydroxyalkoxy with 2-4 carbon atoms, alkoxyalkoxy with a total of 3-6 carbon atoms, unsubstituted or substituted alkyl with 1-4 carbon atoms, the substituent being selected from the group consisting of chlorine, bromine, cyano and hydroxyl;

$Y_1$ is hydrogen, chlorine, bromine, alkoxy with 1 to 4 carbon atoms, hydroxyalkoxy with 2-4 carbon atoms, alkoxyalkoxy with a total of 3-6 carbon atoms, —NH—CO—$Y_2$, —NH—$SO_2$—$Y_2$ or unsubstituted or substituted alkyl with 1 to 4 carbon atoms, the substituent being selected from the group consisting of chlorine, bromine, cyano and hydroxyl;

$Y_2$ is phenyl, amino, N-alkylamino with 1 to 4 carbon atoms, or alkyl with 1-4 carbon atoms unsubstituted or substituted by a substituent selected from the group consisting of phenyl, chlorine, bromine, cyano, hydroxyl, alkoxy with 1 to 2 carbon atoms and phenoxy;

$R_2$ is hydrogen, hydroxyalkyl with 2-4 carbon atoms, alkenyl with 3-6 carbon atoms or alkyl with 1-6 carbon atoms unsubstituted or substituted by chlorine, bromine, cyano, hydroxyl, alkoxy with 1–4 carbon atoms, hydroxyalkoxy with 1 to 4 carbon atoms, phenyl, alkanoyloxy with 2–4 carbon atoms, alkoxycarbonyl with 1 to 4 carbon atoms, hydroxycarbonyl with 2–4 carbon atoms, alkoxycarbonyl with 1 to 4 carbon atoms, hydroxycarbonyl with 2–4 carbon atoms, alkylaminocarbonyloxy with 2–4 carbon atoms or phenylaminocarbonyloxy;

$R_3$ is hydroxyalkyl with 2 to 4 carbon atoms, alkenyl with 3 to 6 carbon atoms, phenyl or unsubstituted or substituted alkyl with 1 to 6 carbon atoms, the substituent being selected from the group consisting of chlorine, bromine, cyano, hydroxyl, alkoxy with 1 to 4 carbon atoms, hydroxyalkoxy with 1–4 carbon atoms, phenyl, alkanoyloxy with 2 to 4 carbon atoms, alkoxycarbonyl with 1 to 4 carbon atoms, hydroxycarbonyl with 2 to 4 carbon atoms; and, if $R_2$ is hydrogen, $R_3$ may also be $—C(CH_3)_2—COOR_4$, methoxy-, ethoxy- or propoxy-alkyl with a total of 4 to 8 carbon atoms; wherein $R_4$ is alkyl with 4 to 8 carbon atoms;

D is phenyl unsubstituted or substituted by at least one substituent selected from the group consisting of chlorine, bromine, nitro, cyano, trifluoromethyl, thiocyano, lower alkyl, lower alkoxy, lower alkylcarbonyl, lower alkylsulphonyl, lower alkylcarbonylamino, carbamoyl, N-lower alkyl carbamoyl, N,N-di-lower alkyl carbamoyl, sulphamoyl, N-lower alkyl sulphamoyl, N,N-di-lower alkyl sulphamoyl, sulphamato, N-lower alkyl sulphamato, N,N-di-lower alkyl sulphamato, lower alkoxycarbonyl, lower alkoxy-lower alkoxycarbonyl, lower alkoxy-lower alkoxy-lower alkoxycarbonyl, hydroxy-lower alkoxy-lower alkoxycarbonyl and lower alkoxycarbonyl-lower alkyl;

$X_2$ is hydrogen, lower alkyl, carbamoyl, cyano, chlorine, bromine, nitroso, nitro, lower alkylcarbonyl, sulphamoyl, lower alkylsulphonyl, lower alkylcarbonylamino or lower alkoxycarbonyl; and Z is hydrogen or lower alkyl;

the dischargeable reactive dyestuffs being those containing reactive moieties of the formula $$—SO_2—CH_2—CH_2—hal$$

$$—SO_2—CH_2—CH_2—O—SO_3M$$

$$—NH—SO_2—CH_2—CH_2—O—SO_3M$$

$$—SO_2—CH{=}CH_2$$

wherein M is hydrogen or a metal cation and hal is halogen, and the resist paste contains an alkali metal sulphite or an alkali metal bisulphite in combination with an alkali metal carbonate or alkali metal bicarbonate.

2. The process according to claim 1 wherein the dischargeable disperse dyestuffs are those of the formula

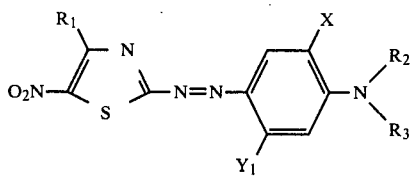

3. The process according to claim 1 wherein the dischargeable reactive dyestuffs are those which contain reactive moieties—$SO_2CH_2CH_2OSO_3M$ or —$NHSO_2CH_2CH_2OSO_3M$.

4. The process according to claim 1 wherein the resist paste contains, as the resisting agent, a previously prepared aldehyde-alkali metal bisulphite adduct.

5. The process according to claim 1 wherein the resist paste additionally contains, as a non-ionic detergent, a polyglycol carboxylic acid ester.

6. Textile materials having resist effects produced by the process of claim 1.

* * * * *